US010233573B2

(12) United States Patent
Beauduin et al.

(10) Patent No.: US 10,233,573 B2
(45) Date of Patent: Mar. 19, 2019

(54) CARPET HAVING A SHADOW EFFECT AND METHOD FOR WEAVING A CARPET FABRIC HAVING A SHADOW EFFECT

(71) Applicant: NV Michel van de Wiele, Kortrijk/Marke (BE)

(72) Inventors: Charles Beauduin, Halle (BE); Johny Debaes, Moorslede (BE)

(73) Assignee: NV Michel Van de Wiele, Kortrijk/Marke (BE)

( * ) Notice: Subject to any disclaimer, the term of this patent is extended or adjusted under 35 U.S.C. 154(b) by 475 days.

(21) Appl. No.: 14/759,479

(22) PCT Filed: Nov. 7, 2013

(86) PCT No.: PCT/EP2013/073271
§ 371 (c)(1),
(2) Date: Jul. 7, 2015

(87) PCT Pub. No.: WO2014/108228
PCT Pub. Date: Jul. 17, 2014

(65) Prior Publication Data

US 2015/0354106 A1 Dec. 10, 2015

(30) Foreign Application Priority Data

Jan. 9, 2013 (EP) ..... 13150582

(51) Int. Cl.
*D03D 27/10* (2006.01)
*D03D 39/16* (2006.01)
*D03D 27/06* (2006.01)

(52) U.S. Cl.
CPC ..... *D03D 27/10* (2013.01); *D03D 27/06* (2013.01); *D03D 39/16* (2013.01)

(58) Field of Classification Search
CPC ..... D03D 27/00; D03D 27/06; D03D 27/10; D06N 7/0065; Y10T 428/23936
See application file for complete search history.

(56) References Cited

U.S. PATENT DOCUMENTS 2,765,813 A * 10/1956 Van den Bergh ..... D03D 27/00 139/391
2,807,286 A * 9/1957 Patrick ..... D03D 27/12 139/401

(Continued)

FOREIGN PATENT DOCUMENTS

CN 103814162 5/2014
DE 319324 C * 3/1920 ..... D03D 27/10

(Continued)

OTHER PUBLICATIONS

Machine translation of DE 319324 C, 1920. (Year: 1920).*

(Continued)

*Primary Examiner* — Cheryl Juska
(74) *Attorney, Agent, or Firm* — Rankin, Hill & Clark LLP

(57) ABSTRACT

A carpet having a shadow effect comprises a backing fabric having weft threads (S) and tension warp threads (S1, S2), further comprising pile warp threads (P) interlaced with the weft threads (S) of the backing fabric and forming pile elements, the weft threads (S) being provided in groups (G) of weft threads repeatedly appearing in a warp direction, each group (G) of weft threads providing a relative positioning of the weft threads (S) thereof relative to at least one tension warp thread (S1, S2), a weft thread (S) of a group (G) being either positioned on a pile side relative to a tension warp thread (S1, S2) or on a back side relative to this tension warp thread (S1, S2) in a respective relative positioning, a first group (G1) of weft threads having a first relative positioning of the weft threads (S) thereof and a second (Continued)

group (G2) having a second relative positioning of the weft threads (S) thereof different from the first relative positioning, wherein the first relative positioning and the second relative positioning provide a substantially mirror-symmetrical arrangement with respect to each other relative to a plane of symmetry (Sy1) extending in the weft direction, and/or wherein in the first relative positioning and the second relative positioning weft threads (S) positioned at a first group end region (E1) in the warp direction and weft threads (S) positioned at a second group end region (E2) in the warp direction have a different relative positioning with respect to at least one tension warp thread (S1, S2).

22 Claims, 6 Drawing Sheets

(56) References Cited

U.S. PATENT DOCUMENTS

| | | | | |
|---|---|---|---|---|
| 2,932,328 | A * | 4/1960 | Hoeselbarth | D03D 39/00 139/192 |
| 5,694,982 | A * | 12/1997 | Debaes | D03D 47/38 139/453 |
| 2002/0189702 | A1* | 12/2002 | Smissaert | D03D 27/10 139/418 |
| 2006/0118196 | A1* | 6/2006 | Debaes | D03D 27/10 139/11 |
| 2006/0137758 | A1* | 6/2006 | Debaes | D03D 27/10 139/11 |
| 2007/0006932 | A1* | 1/2007 | Mertens | D03D 27/10 139/37 |
| 2007/0102056 | A1* | 5/2007 | Debaes | D03D 27/00 139/21 |
| 2007/0125440 | A1* | 6/2007 | Debaes | D03D 27/10 139/383 R |
| 2008/0053557 | A1* | 3/2008 | Debaes | D03D 27/06 139/404 |
| 2014/0338783 | A1* | 11/2014 | Debaes | D03D 27/10 139/21 |
| 2015/0354107 | A1* | 12/2015 | Debaes | D03D 27/10 139/21 |
| 2016/0201235 | A1* | 7/2016 | Debaes | D03D 27/06 139/21 |

FOREIGN PATENT DOCUMENTS

| | | | | |
|---|---|---|---|---|
| DE | 4303273 | C1 * | 12/1993 | D03D 27/10 |
| EP | 1081260 | | 3/2001 | |
| EP | 1251195 | | 10/2002 | |
| EP | 1746190 | | 1/2007 | |
| EP | 2894244 | A1 * | 7/2015 | D03D 27/10 |
| EP | 3192909 | A1 * | 7/2017 | D03D 27/10 |
| GB | 696963 | | 9/1953 | |
| WO | 2013041938 | | 3/2013 | |
| WO | WO-2017121673 | A1 * | 7/2017 | D03D 27/10 |

OTHER PUBLICATIONS

Office Action and Search Report of CN Application No. 2013800700341 dated May 11, 2016, 13 pages.

International Search Report and Written Opinion of PCT/EP2013/073271 dated May 15, 2014, 11 pages.

* cited by examiner

CARPET HAVING A SHADOW EFFECT AND METHOD FOR WEAVING A CARPET FABRIC HAVING A SHADOW EFFECT

The present invention relates to a carpet, in particular a wall to wall carpet, having a shadow effect and further relates to a method for weaving such a carpet fabric having a shadow effect.

For providing a carpet having a structural pattern or a colour pattern on its front side, i.e. the side that can be seen when the carpet is positioned on a floor, it is known to either use warp threads of different colour for providing a pattern or to use structural weave elements such as, for example, cut piles, pile loops or ribs or combinations thereof for providing a structural pattern on the front side of the carpet. Even a combination of such weaving structures with differently coloured pile warp threads for providing the cut piles, the pile loops or the ribs is known.

It is the object of the present invention to provide a carpet having a shadow effect and a method for weaving a carpet fabric having a shadow effect by means of which a visually recognizable pattern can be provided at a carpet front side in an easy manner.

According to a first aspect of the present invention, this object is achieved by a carpet having a shadow effect, comprising a backing fabric having weft threads and tension warp threads, further comprising pile warp threads interlaced with the weft threads of the backing fabric and forming pile elements, the weft threads being provided in groups of weft threads repeatedly appearing in a warp direction, each group of weft threads providing a relative positioning of the weft threads thereof relative to at least one tension warp thread, a weft thread of a group being either positioned on a pile side relative to a tension warp thread or on a back side relative to this tension warp thread in a respective relative positioning, a first group of weft threads having a first relative positioning of the weft threads thereof and a second group having a second relative positioning of the weft threads thereof different from the first relative positioning, wherein the first relative positioning and the second relative positioning provide a substantially mirror-symmetrical arrangement with respect to each other relative to a plane of symmetry extending in the weft direction, and/or wherein in each relative positioning of first relative positioning and second relative positioning a weft thread positioned at a first group end region in the warp direction and a weft thread positioned at a second group end region in the warp direction have a different relative positioning with respect to at least one tension warp thread, which means that in the first relative positioning and the second positioning weft threads positioned at a first group end region in the warp direction and weft threads positioned at a second group end region in the warp direction have a different relative positioning with respect to at least one tension warp thread.

With providing such groups of weft threads in a carpet, due to an interaction of the pile warp threads which are visible at the front side of the carpet with these weft threads, a particular orientation of the pile elements constituted by the pile warp threads can be obtained and can be varied across the front side of the carpet. Due to such a variation of the orientation, i.e. inclination of the pile elements constituted by the pile warp threads, such a carpet has a varying light reflection capability across the front side such that there appears a pattern which is visually recognizable and which may also vary when viewing such a carpet from different directions and under different angles. Such a carpet having a shadow effect structure can either be woven with coloured yarn or can be woven with uncoloured yarn and later on can be coloured individually, for example, in a colour bath, according to a customer's desire. In this case, for example, polyamide material or polyester material could be used for the pile warp threads. After applying a colour to such a carpet, the pattern provided by the shadow effect can be clearly seen on the front side of the carpet. This reduces the delivery times and the need for a stock of yarns in different colours or for carpets in different colours.

In the context of the present invention such a group of weft threads is constituted by a plurality of weft threads positioned adjacent to each other in the warp direction. One of these weft threads is positioned at a first group end region and another one is positioned at a second group end region in the warp direction. Each group constitutes an entity of weft threads provided in the respective relative positioning and repeatedly appearing in the warp direction. While of course between two such groups of weft threads there may be weft threads which are not associated to one of these two groups, the weaving structure of a carpet, as far as the weft threads are concerned, may be constituted exclusively by repeatedly appearing groups of weft threads positioned adjacent to each other and therefore following each other in the warp direction.

For more clearly defining the above-referenced plane of symmetry, it can be stated that this plane not only extends in the weft direction but additionally is perpendicular with respect to a plane containing the weft direction and the warp direction.

Such carpets having a shadow effect are provided with more plain variations at their front side and, therefore, can be combined with modern interiors. In particular, such carpets can also be used for wall-to-wall applications.

For generating a particular pattern on the front side of a carpet by adjusting the inclination of the pile elements, for example, pile legs or pile loops, it is proposed that at least one first group is arranged immediately adjacent to a first group in the warp direction, and/or at least one second group is provided immediately adjacent to a second group in the warp direction, and/or that at least one first group is provided immediately adjacent to a second group in the warp direction.

For increasing the variety of pile element positionings for obtaining a desired pattern, it is further proposed that a third group has a third relative positioning of the weft threads thereof which is different from the first relative positioning and the second relative positioning, at least one third group being positioned between two first groups and/or between two second groups and/or between a first group and a second group.

For discriminating such a third group of weft threads from the first and the second groups of weft threads, it is proposed that the weft threads of the third group are arranged substantially mirror-symmetrical with respect to each other relative to a symmetry plane extending in the weft direction and being positioned in a central region of the third group in the warp direction, and/or a weft thread positioned at a first group end region of a third group in the warp direction and a weft thread positioned at a second group end region of the same third group in the warp direction have the same relative positioning with respect to at least one tension warp thread. Again the above-referenced plane of symmetry can more clearly be defined as a plane not only extending in the weft direction but also being substantially perpendicular with respect to a plane containing the weft direction and the warp direction.

According to another very advantageous aspect of the present invention, in the first group of weft threads and/or the second group of weft threads and/or the third group of weft threads a weft thread positioned at a first group end region in the warp direction and/or a weft thread positioned at a second group end region in the warp direction is thinner than at least one weft thread positioned therebetween in the warp direction. According to this aspect, the or at least one weft thread positioned in a centre region of a respective group of weft threads is thicker than at least one of the weft threads positioned at the two group end regions, which leads to an enhanced shadow effect. For example, such a thicker weft thread may have a thickness that is in the range of 110% to 150%, preferably 150% to 200%, more preferably more than 200% of the thickness of such a thinner weft thread positioned at a group end region. This, for example, may refer to the diameter of a substantially circular cross-section of such weft threads.

According to a further aspect of the invention, it is proposed that a plurality of warp thread systems extending in the warp direction are provided side by side, a row of pile elements extending in the warp direction being provided by each warp thread system.

For providing a sufficient stability in the backing fabric of the carpet according to the present invention, it is proposed that at least one warp thread system, preferably a plurality of warp thread systems, further preferably each warp thread system, comprises at least one tension warp thread.

Further, in at least one row of pile elements there may be at least one change in the type of the pile warp threads used for providing the pile elements. Those pile warp threads not used for forming pile elements can be bound into the backing fabric. By changing the pile warp threads used for forming pile elements, it is possible to provide a colour change, for example by using differently coloured warp threads or by using differently structured pile warp threads or pile warp threads made of different materials which when coming into contact with a colour after the carpet has been woven provide different colouring effects.

According to a further aspect, at least one warp thread system, preferably a plurality of warp thread systems, further preferably each warp thread system may comprise one tension warp thread and the at least one weft thread, i.e. the thicker weft thread, positioned between the weft threads positioned at the group end regions is positioned at a pile side relative to the tension warp thread.

The stability and the volume of the backing fabric can be further increased if at least one warp thread system, preferably a plurality of warp thread systems, further preferably each warp thread system, comprises two tension warp threads, preferably offset with respect to each other in a direction from the pile side to the back side, and/or if tension warp threads of different warp thread systems are offset with respect to each other in a direction from the pile side to the back side.

For ensuring that the two tension warp threads of a warp thread system remain positioned offset with respect to each other, it is proposed that two tension warp threads are separated in the direction from the pile side to the back side by at least one weft thread, preferably of a first group of weft threads and/or a second group of weft threads.

According to a further preferred aspect of the invention, it is proposed that each first group of weft threads and/or each second group of weft threads and/or each third group of weft threads comprises at least one weft thread positioned at the pile side of the two tension warp threads and at least one weft thread positioned at the back side of the two tension warp threads. This leads to a further increase of the volume of the backing fabric. Such a relative positioning of the weft threads can also be used in warp thread systems having only a single tension warp thread.

According to a further aspect, each first group of weft threads and/or each second group of weft threads may comprise at least one weft thread positioned between the two tension warp threads.

The strength of the backing fabric and the defined positioning of the pile warp threads interlaced in the backing fabric can be increased if at least one warp thread system, preferably a plurality of warp thread systems, further preferably each warp thread system, comprises at least one binding warp thread.

According to a further advantageous aspect of the invention, a first group and a second group and preferably a third group may comprise three weft threads, respectively, and/or a first group and a second group and preferably a third group may comprise the same number of weft threads. According to a very advantageous aspect of the invention, all the groups, i.e. all first groups, second groups, and preferably third groups may comprise three weft threads and/or the same number of weft threads.

For increasing the quality of the pattern by providing a defined positioning of the pile elements which can be seen at the front side of the carpet, it is proposed that a pile element, preferably two pile elements, are provided in at least one region where two groups are adjacent to each other. Such pile elements preferably are provided by the same pile warp thread system and therefore are members of the same row of pile elements constituted by such a warp thread system. Further pile elements may be provided substantially only in a region where two groups are adjacent to each other.

By providing the above-referenced groups of weft threads and interlacing the pile warp threads with these weft threads in a defined manner, the shadow effect and, therefore, a pattern visible at the front side of the carpet is generated due to the inclination or non-inclination of pile elements. Therefore, according to a further aspect of the invention, it is proposed that in a region where a first group and a further first group are adjacent to each other at least one pile leg or a pile loop providing a pile element is inclined in the warp direction in a first orientation, and in a region where a second group and a further second group are adjacent to each other at least one pile leg or a pile loop providing a pile element is inclined in the warp direction in a second orientation opposite to the first orientation, and/or in a region where a first group is adjacent to a second group or in a region where a third group is adjacent to a third group at least one pile leg or a pile loop providing a pile element is substantially not inclined in the warp direction, and/or in a region where a third group is adjacent to a first group or a second group at least one pile leg or pile loop providing a pile element is inclined in the warp direction or is substantially not inclined.

For increasing the variability of the pattern provided on a carpet, it is proposed that, between at least two adjacent groups of weft threads, a binding element different from the first group of weft threads, the second group of weft threads, and the third group of weft threads is provided, said binding element comprising at least one weft thread, preferably a plurality of weft threads offset with respect to each other in the warp direction and/or the direction from the pile side to the back side. This means that it is not necessary that, throughout an entire carpet, the above-referenced groups of weft threads must be positioned immediately side by side. Instead, between two such groups or in particular regions of the carpet, additional binding elements having one or a plurality of weft threads and possibly comprising pile warp threads interlaced with such weft threads can be provided.

For enhancing the stability and the durability of the carpet of the present invention, in particular in environments of high humidity, it is proposed that at least one weft thread, preferably all the weft threads of at least one group of weft threads, comprise fibrillated yarn and/or are made of polypropylene material.

For providing a stable contact between the carpet of the present invention and a floor supporting such a carpet, it is proposed that at the back side a ground contact material, preferably latex material, is arranged preferably engaging into the backing fabric.

According to a further aspect of the present invention, the above object is achieved by a method for weaving at least one carpet fabric having a shadow effect, in particular according to one of the preceding claims, wherein in association to at least one dent, preferably to a plurality of dents, further preferably to each dent, of a weaving machine a warp thread system for providing a row of pile elements extending in a warp direction is provided, the warp thread system comprising at least one pile warp thread, preferably at least two pile warp threads, and in association to each carpet fabric to be woven comprises at least one tension warp thread and at least one binding warp thread for providing a backing fabric together with weft threads, wherein groups of weft threads repeatedly appearing in each fabric are provided in such a manner that a first group of weft threads has a first relative positioning of the weft threads thereof relative to a tension warp thread and a second group has a second relative positioning of the weft threads thereof relative to a tension warp thread different from the first relative positioning, wherein the first relative positioning and the second relative positioning are substantially mirror-symmetrical with respect to each other relative to a symmetry plane extending in the weft direction, and/or in each relative positioning of first relative positioning and second relative positioning a weft thread positioned at a first group end region in the warp direction and weft thread positioned at a second group end region in the warp direction have a different relative positioning with respect to at least one tension warp thread, wherein in a relative positioning a respective weft thread of a group either is positioned at a pile side of a tension warp thread or at a back side of this tension warp thread, wherein two pile elements of the same pile warp thread system are provided in at least one region where two groups G are adjacent to each other.

According to a particularly advantageous aspect of the present invention, two carpet fabrics connected with each other by pile warp threads and separated from each other by cutting the pile warp threads may be woven, and/or at least one warp thread system in association to at least one carpet fabric may comprise two tension warp threads preferably offset with respect to each other in a direction from a pile side to a back side, and/or tension warp threads of different warp thread systems may be offset with respect to each other in a direction from the pile side to the back side. This can be obtained by positioning a particular weft thread on a pile side relative to a tension warp thread, for example the only tension warp thread of one warp thread system and positioning the same weft thread on the back side relative to a tension warp thread, for example the only tension warp thread of an immediately adjacent warp thread system.

Alternatively or additionally, the weft threads may be inserted by means of a single weft insertion means, preferably gripper mechanism, per each carpet fabric to be woven in a predetermined weft insertion plane.

At least a part of the tension warp threads, preferably each tension warp thread, may be moved by means of a Jacquard machine for forming a shed. By forming a shed for inserting weft threads by moving at least a part of the tension warp threads, preferably each tension warp thread, by means of a Jacquard machine, it is possible to reduce the number of necessary weft insertion means for obtaining different positionings of weft threads relative to at least one tension warp thread, while ensuring a high variability in the positioning of the tension warp threads relative to the weft threads. Further, when using a Jacquard machine for moving tension warp threads, there exist more patterning possibilities as compared to moving the tension warp threads, for example, by a heddle frame drive.

A contact between a carpet to be woven with such a method according to the present invention and the floor supporting the carpet can be enhanced if a floor contact material, preferably latex material, is provided at a back side of at least one fabric preferably engaging into the backing fabric.

It is to be noted that the method of the present invention can be used for providing each one of the above-referenced structural features of the carpet of the present invention, either alone or in combination with one or a plurality of the other structural features referred to.

In the following, the present invention will be explained with reference to drawings in which.

Figure 7:
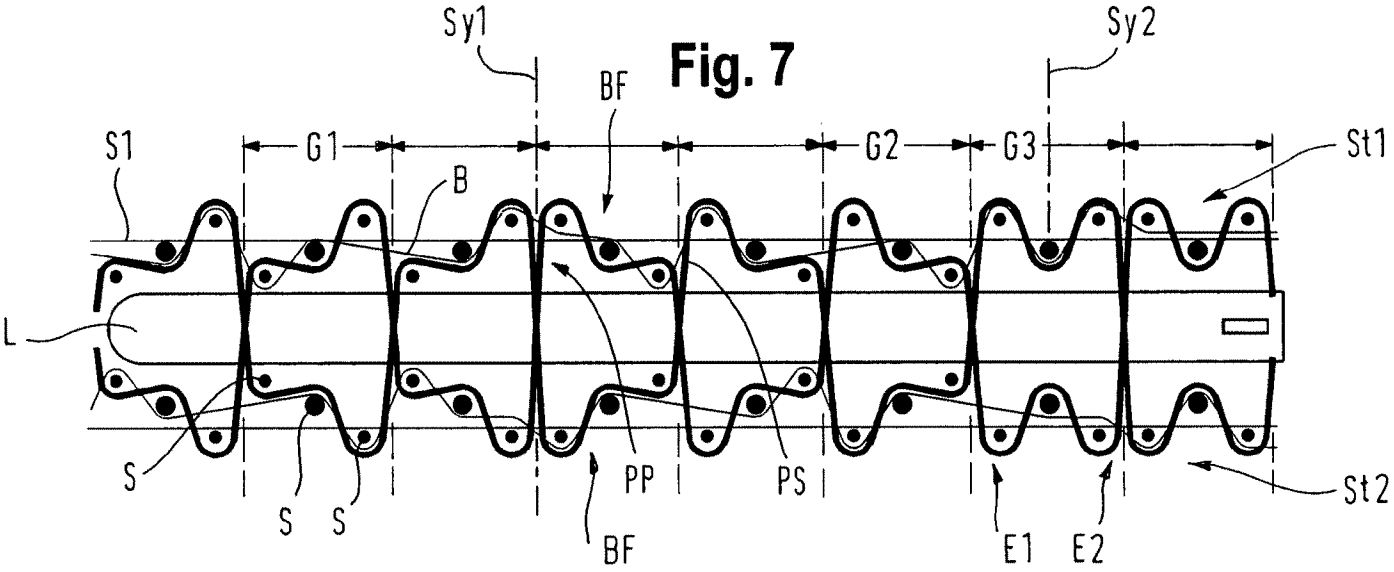
FIG. 7 shows an alternative weaving structure of a warp thread system.
Figure 7A:
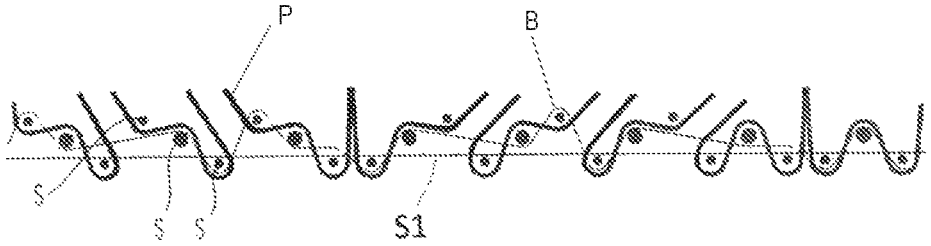
Figure 7B:
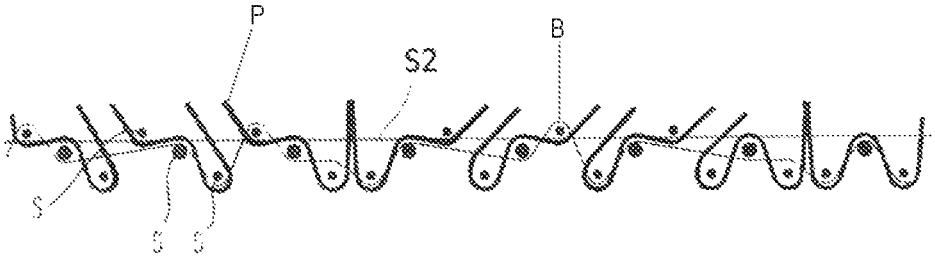

FIGS. 7*a* and 7*b* show a lower part of FIG. 7 after having cut the pile warp threads extending between the two backing fabrics in the middle between the backing fabrics. FIGS. 7*a* and 7*b* show two different sections of a carpet in the warp direction, each one showing the pile warp threads generated by and the tension warp threads of a single warp thread system.

Figure 8:
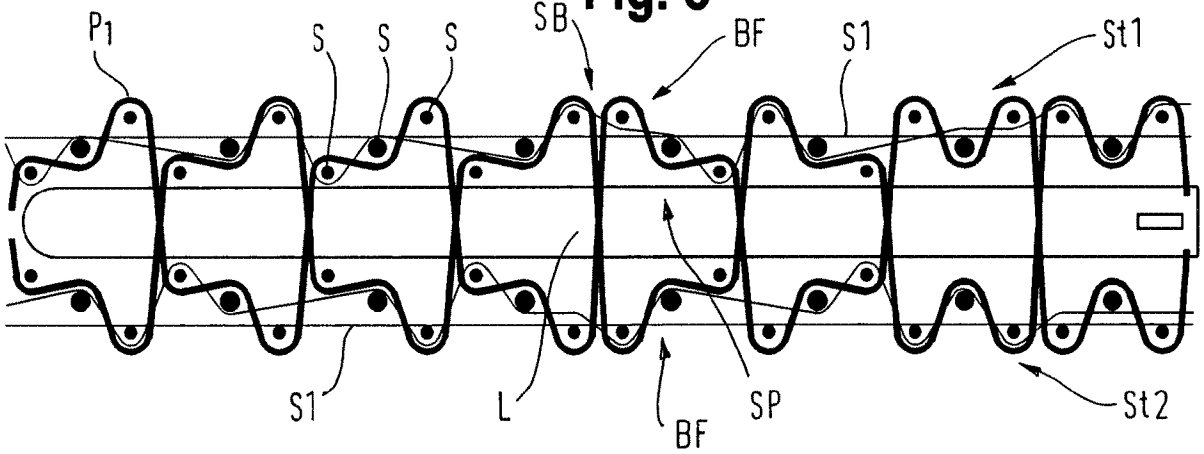
Figure 9:
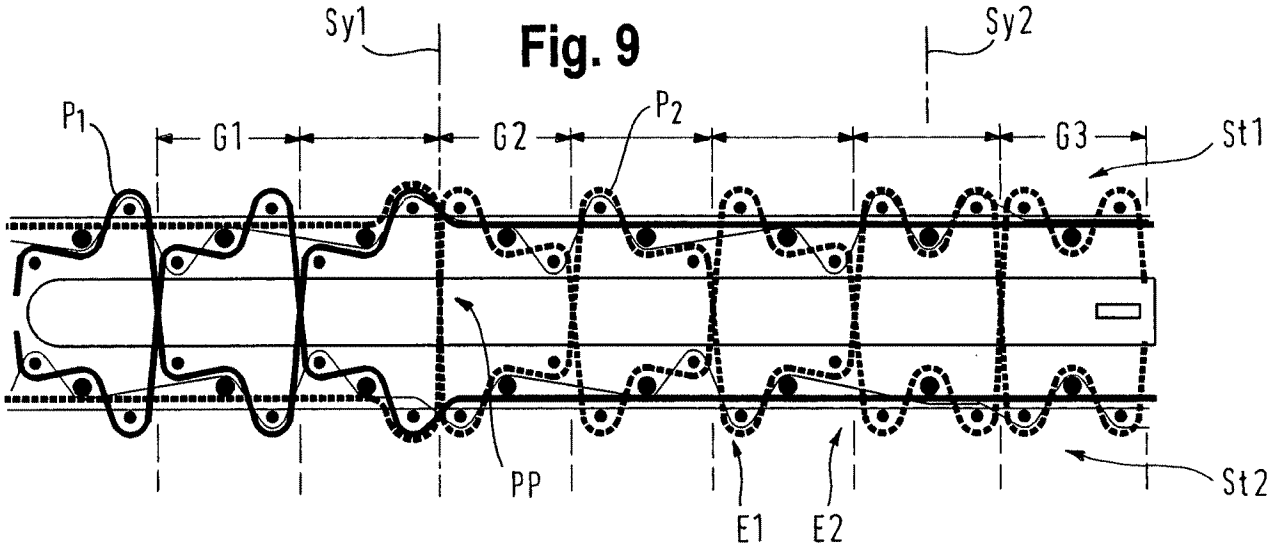
Figure 10:
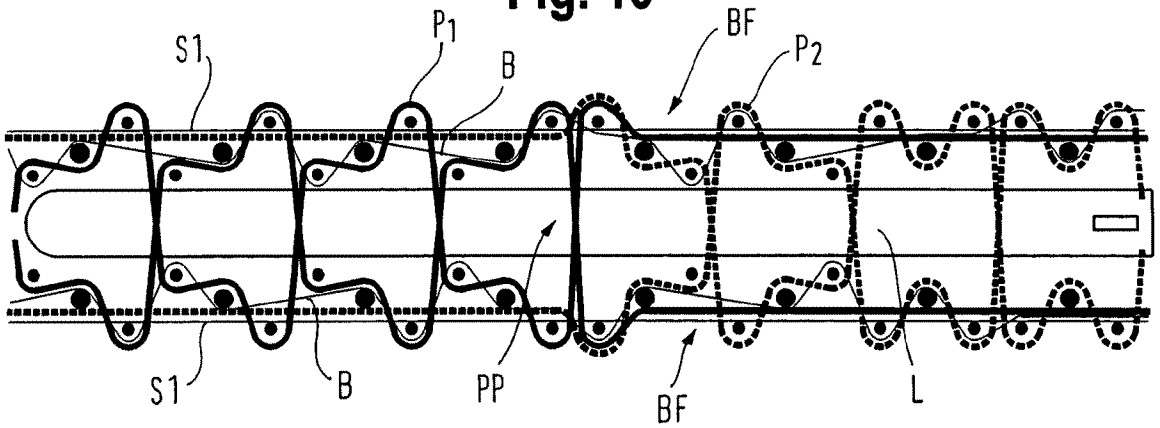

FIG. 8 shows the weaving structure of a warp thread system positioned adjacent to the warp thread system of FIG. 7;

FIG. 9 shows an alternative weaving structure of a warp thread system;

FIG. 10 shows the weaving structure of a warp thread system positioned adjacent to the warp thread system of FIG. 9.

Figure 1:
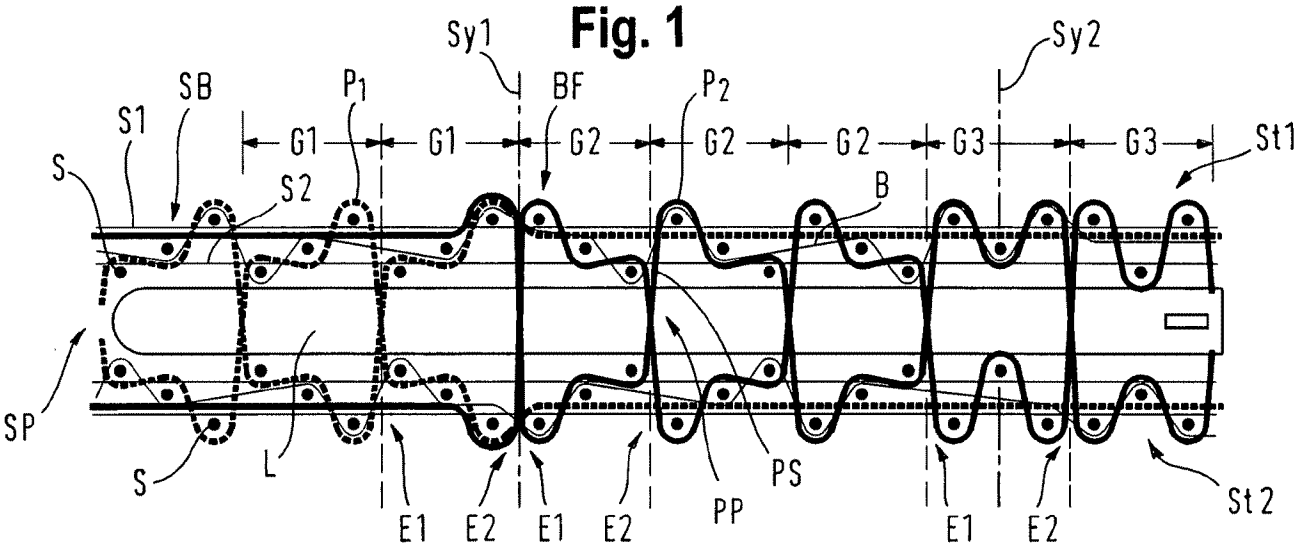
FIG. 1 shows, in association to a warp thread system, a weaving structure of two carpet fabrics woven face to face for obtaining two carpets, in particular wall-to-wall carpets, having a shadow effect.

FIG. 1 shows a longitudinal section, i.e. a section in a warp direction of two carpet fabrics St1, St2 woven face to face and connected to each other by means of pile warp threads $P_1$, $P_1$, $P_2$, $P_2$. In FIG. 1 the content of one dent, i.e. one warp thread system, is shown. The two fabrics St1, St2 can be separated from each other by cutting the pile warp threads $P_1$, $P_1$, $P_2$, $P_2$ between the two fabrics St1, St2 such that pile legs PS constituting pile elements appear at respective pile points PP in each carpet provided by a carpet fabric St1, St2.

As can be seen from FIG. 1, the two fabrics St1, St2 are substantially identical with respect to each other so that, in the following, the description of a respective carpet fabric St1, St2 is primarily given with respect to the top fabric St1 in FIG. 1.

In each fabric St1, St2, there are provided groups G1, G2, and G3 of weft threads S. Further, the fabric St1, and therefore also the fabric St2, comprises two tension warp threads S1, S2 offset with respect to each other from a pile side SP to a back side SB. It is to be noted that the pile side SP constitutes the front side of a carpet which can be seen when the carpet is positioned on a floor. The back side SB is the side of the carpet which will be in contact with the floor.

Each fabric St1, St2 further comprises, preferably in association to each warp thread system, a binding warp thread B such that, in association to at least one warp thread system, a backing fabric BF of a respective fabric St1, St2 comprises the two tension warp threads S1, S2, the weft threads S and the binding warp thread B.

In this context, it is to be noted that such a warp thread system as shown in FIG. 1 is a group of warp threads commonly associated to one dent of a reed during a weaving process. A carpet and the respective carpet fabrics St1, St2 are constituted by a plurality of such warp thread systems positioned side by side in the weft direction.

Figure 2:
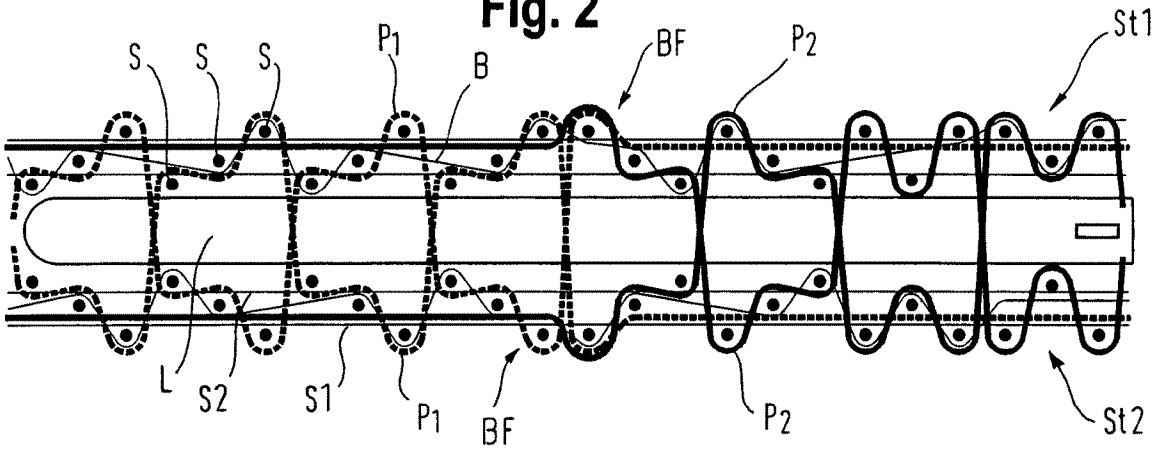
FIG. 2 shows the weaving structure of a warp thread system positioned adjacent to the warp thread system of FIG. 1.

FIG. 2 shows another warp thread system which, for example, can be positioned immediately adjacent to the warp thread system of FIG. 1 in the fabrics St1, St2. As can be seen from FIGS. 1 and 2, the weaving structure provided in association to these two different warp thread systems can be rather similar to each other. One major difference is that the binding warp threads B of these two warp thread systems, which binding warp threads B are basically used in the same manner in both warp thread systems, are shifted with respect to each other in the warp direction, so that each of the weft threads S positioned at the pile side SP of the two fabrics St1, St2 is fixed by a binding warp thread B at a plurality of locations in the weft direction. A carpet may be constituted of these two warp thread systems positioned adjacent to each other in an alternately repeating manner. Of course, other additional weaving structures of warp thread systems can be used. Further, it is to be noted that not necessarily all the warp thread systems must have the same number of warp threads and must contain the same kinds of warp threads.

Due to the fact that the warp thread system shown in FIG. 2, with respect to those aspects which are essential for the present invention, basically shows the same structure as the warp thread system of FIG. 1, in the following, the present invention is primarily explained with respect to the warp thread system shown in FIG. 1.

In the various groups G1, G2, G3 of weft threads shown in FIG. 1, the weft threads S used for constituting these groups are provided in different relative positionings with respect to the two tension warp threads S1, S2. For example, a weft thread S provided in a first group end region E1 of a first group G1 is positioned at the pile side SP of both tension warp threads S1, S2. A weft thread S provided at a second group end region E2 of a respective first group G1 is positioned at the back side SB of both tension warp threads S1, S2. The third weft thread S of each first group G1 is positioned between the two tension warp threads S1, S2 and, therefore, is positioned between the two weft threads S positioned at the two group end regions E1, E2 in a direction from the back side SB to the pile side SP.

The arrangement of the weft threads S of the second groups G2 is substantially mirror-symmetrical with respect to a plane of symmetry Sy1 that is shown in FIG. 1 as a plane which extends in the weft direction and which is substantially perpendicular with respect to the warp direction. This means that a weft thread S positioned at a first group end region E1 of a second group G2 is positioned at the back side SB of the two tension warp threads S1, S2, while the weft thread S positioned at the other group end region E2 of a respective second group G2 is positioned at the pile side SP of the two tension warp threads S1, S2. The third weft thread S located in a central region of the second groups G2 is positioned between the two tension warp threads S1, S2.

In the third groups G3, the arrangement of the weft threads S is substantially mirror-symmetrical relative to a plane of symmetry Sy2, which is also shown as a plane extending in the weft direction and being perpendicular with respect to the warp direction. This means that, for example, the two weft threads S positioned at the two group end regions E1, E2 are positioned at the back side SB of both tension warp threads S1, S2, while the weft thread positioned in the centre of the third groups G3 is either positioned between the two tension warp threads S1, S2 or is positioned at the pile side SP of the two tension warp threads S1, S2. This means that there can exist two different kinds of third groups G3.

The pile warp threads $P_1$, $P_1$, $P_2$, $P_2$ which are used for generating pile legs PS as pile elements in the fabrics St1, St2 are alternately interlaced with weft threads S associated to the top fabric St1 and with weft threads S associated to the bottom fabric St2. The weaving structure used is a so-called 3/6W-weave wherein, in each group, the pile warp thread coming from the other fabric is interlaced with a weft thread positioned at one group end region E1, E2 on the back side SB, then is led around the weft thread positioned in the centre of this group at the pile side SP thereof, and finally is interlaced with the weft thread positioned at the other group end region E2, E1 at the back side SB thereof. This leads to a structure in which, in each region where two groups G1, G1, or G1, G2, or G1, G3, or G2, G3 are immediately adjacent to each other, pile points PP are constituted by two pile legs PS after cutting the pile warp threads $P_1$, $P_1$, $P_2$, $P_2$.

The two pile warp threads $P_1$, $P_1$ or $P_2$, $P_2$ which are used simultaneously for forming pile points PP are interlaced with the backing fabrics BF of the two fabrics St1, St2 such that, in these two fabrics St1, St2, a substantially mirror-symmetrical arrangement of the pile warp threads and the pile legs constituted by them is obtained.

Depending on the kind of groups which are positioned immediately adjacent to each other, these pile legs PS will either be inclined or not inclined in the warp direction. For example, in the region where, in FIG. 1, the plane of symmetry Sy1 is shown, the two pile legs PS will be oriented substantially perpendicular with respect to the warp direction, i.e. will not be inclined. In a region where two first groups G1 are positioned immediately adjacent to each other, due to the fact that the two immediately neighbouring weft threads S of different groups are offset with respect to each other in the direction from the pile side SP to the back side SB, the two pile legs PS will be inclined to the left side in FIG. 1. In a region where two second groups G2 are adjacent to each other, the two pile legs PS constituting a pile point PP will also be inclined, however, to the other side, i.e. the right side in FIG. 1. In regions in which a first group G1 or a second group G2 is positioned immediately adjacent to a third group G3, the direction of inclination of the pile legs will depend on the relative positioning of these two groups. If, for example, in FIG. 1, a second group G2 is positioned on the left side of a third group G3, the pile legs PS providing the pile point PP in this region will be inclined to the right side in FIG. 1, i.e. in the same direction that will occur in a region in which two second groups G2 are positioned adjacent to each other. If the second group G2 is positioned on the right side of the third group G3, then, due to the fact that the immediately neighbouring weft threads S of these two different groups are both positioned on the back side SB relative to the two tension warp threads S1, S2, the pile legs PS provided in this region will be substantially not inclined. It is obvious that the same situation applies if a first group G1 is positioned immediately adjacent to the third group G3.

By combining the respective groups G1, G2, and G3 in a predefined sequence in the warp direction, it is possible to control the inclination of the pile legs PS in particular regions of the fabrics St1, St2 and to thereby generate a structural pattern that can be seen at the pile side SP, i.e. the front side of a carpet. This pattern will appear irrespective of the colour of the pile warp threads used for providing these pile legs PS. Of course, the use of different colours can emphasize the pattern or lead to an additional pattern that is superimposed to the pattern provided by the inclination of the pile legs PS.

As can be seen in FIG. 1, for example, in the region where a first group G1 is immediately adjacent to a second group G2, there can be a change in the pile warp threads used for providing the pile legs PS from pile warp threads $P_1$, $P_1$ shown as dashed lines to pile warp threads $P_2$, $P_2$ shown as black lines. Before the pile warp threads $P_2$, $P_2$ start forming pile elements, they are bound into a respective fabric St1, St2 preferably in a straight manner and in the same region where the outer tension warp threads $S_1$, $S_1$ extend, i.e. the tension warp threads which are positioned nearer to the back side SB of the backing fabrics BF. The same applies to the pile warp threads $P_1$, $P_1$, which after forming pile elements are bound into the backing fabrics BF in a substantially straight manner and in the same region in which the outer tension warp threads S1, S1 extend. By changing the pile warp threads which are used for forming pile legs it is possible to either make a change in the colour if coloured pile warp threads are used or to have a change in the colour absorbing characteristic if such a carpet is coloured after it has been woven. In any case, at such a position where a change in the pile forming pile warp threads occurs, there is a change in the type of the pile warp threads used in a particular row of pile elements.

As can be seen in FIGS. 1 and 2, for providing the two fabrics St1, St2 with the desired length of the pile legs PS thereof, a lancet L can be used during the weaving process. During this process, the entire weaving structure is moved along this lancet L towards the free end thereof, which, in FIG. 1, is positioned at the left side.

A weaving structure shown in FIGS. 1 and 2 can be woven on a weaving loom equipped with a Jacquard machine. According to a very advantageous aspect of the present invention, this Jacquard machine is used to move the tension warp threads S1, S2 of the two fabrics St1, St2 for forming sheds for introducing the weft threads S. This means that the weaving structure shown in FIGS. 1 and 2 can be woven by using a single weft insertion means in association to each fabric St1, St2, i.e. a total of two weft insertion means, for example, gripper mechanisms. All the weft threads S which later on are positioned offset with respect to each other in the direction from the pile side SP to the back side SB in one fabric are inserted in one and the same predetermined weft insertion plane. Due to the fact that the tension warp threads which are moved by the Jacquard machine are put under a rather high tension, the weft threads, after having been inserted, will either be moved to the back side SB or to the pile side SP, or will be kept between the two tension warp threads S1, S2. When using a Jacquard machine for moving the tension warp threads S1, S2, it is necessary to make sure that the spring members which are used for generating counterforces for lowering the heddles guiding the tension warp threads S1, S2 are able to provide a sufficient force acting against the pretension of the tension warp threads S1, S2.

By moving the tension warp threads by means of a Jacquard machine, it is possible to obtain a rather high variability in the positioning of the weft threads without the necessity of inserting these weft threads at different weft insertion planes. Further, the Jacquard machine can additionally be used to move the pile warp threads either for forming pile elements or for providing them bound into the backing fabrics. If such a variation in the binding structure of the pile warp threads is not necessary, these pile warp threads can also be moved by heddle frames, as is the case with the binding warp threads.

For increasing the volume and the stability of the backing fabrics BF and for providing enhanced durability of the fabrics St1, St2 even in environments of high humidity, the weft threads S are preferably made of fibrillated yarns and are further preferably made of polypropylene material. The yarn used for providing the pile warp threads may be coloured or uncoloured. If uncoloured pile warp threads are used, then after weaving the fabrics St1, St2 and the carpets constituted by these fabrics St1, St2 with a particular pattern provided by the shadow effect of the inclined pile elements, such a carpet can be coloured according to a customer's wish such that a customized carpet having the shadow effect pattern provided by the inclined pile legs can be obtained.

It is to be noted that in FIGS. 1 and 2 there is shown a weaving structure in which relating to the arrangement of the various groups G1, G2, G3 of weft threads the two fabrics St1 and St2 have an identical arrangement such that there where for example a first group G1 is used in the top fabric St1 a first group G1 is also used in the bottom fabric St2. This leads to a substantial symmetrical arrangement of the weft threads in the two fabrics St1, St2 with respect to a plane of symmetry extending between these two fabrics St1, St2. However, in particular when moving the tension warp threads S1, S2 by a Jacquard machine it is possible to select the various groups of weft threads for the two fabrics St1, St2 independently from each other. This means that for example at a location, where in the top fabric St1 a first group G1 is used, a second group G2 or a third group G3 can be used in the bottom fabric St2 and vice versa. Due to this it is possible to produce two fabrics St1, St2 which not necessarily have a mirror-symmetrical pattern at their pile sides SP.

Figure 3:
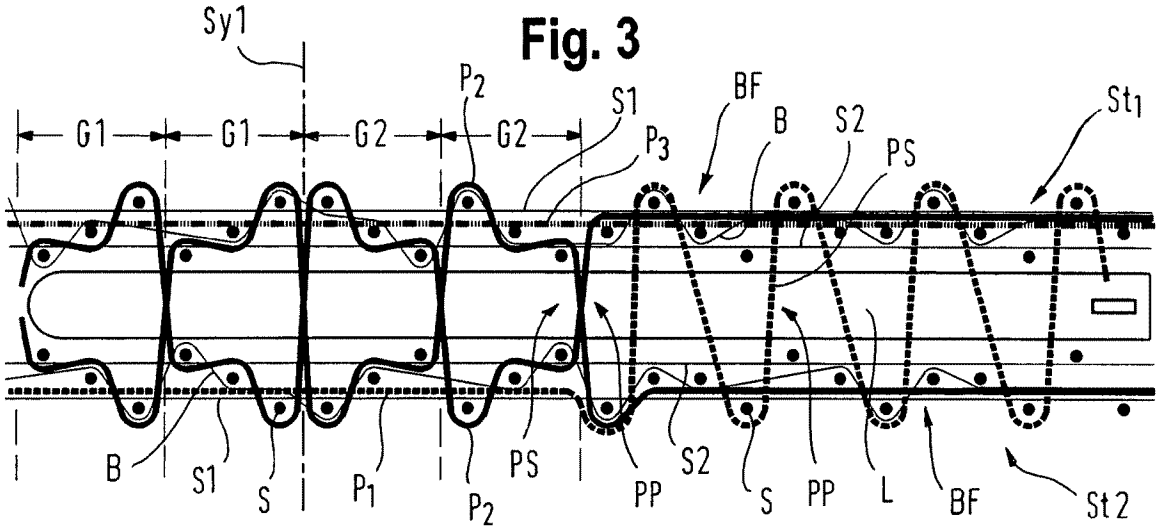
FIG. 3 shows an alternative weaving structure of a warp thread system.
Figure 4:
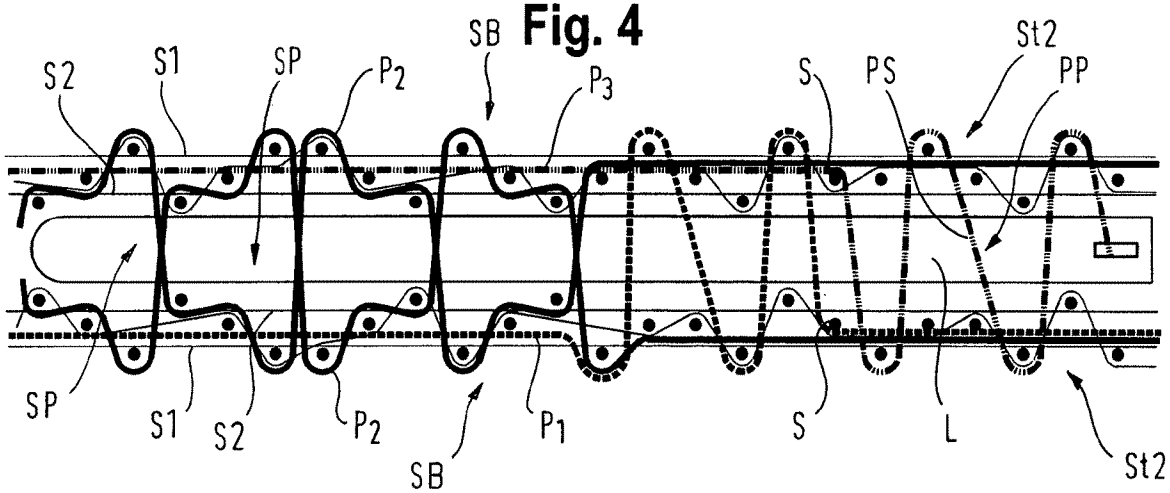
FIG. 4 shows the weaving structure of a warp thread system positioned adjacent to the warp thread system of FIG. 3.

In FIGS. 3 and 4, an alternative embodiment of a weaving structure of a carpet having a shadow effect is shown. As is the case in FIGS. 1 and 2, FIGS. 3 and 4 show the warp yarn systems associated to two consecutive dents. These two warp yarn systems can be alternately repeated in the weft direction.

Each warp thread system comprises two tension warp threads S1, S2 as well as a single binding warp thread B in association to each fabric St1, St2. Further, the warp thread systems shown in FIGS. 3 and 4 comprise a single pile warp thread $P_1$, two pile warp threads $P_2$, and a single pile warp thread $P_3$. Each of these pile warp threads $P_1$, $P_2$, $P_2$, $P_3$ can either be used for forming pile legs PS as pile elements at respective pile points PP or can be bound into the fabric St1, St2 in the same region in which the outer tension warp threads S1, S1 are arranged.

The weaving structure shown in FIGS. 3 and 4 is constituted of a combination of the 3/6W-weave shown in FIGS. 1 and 2 and a 1/3V-weave. In the left part of FIGS. 3 and 4, there are shown four groups of weft threads S comprising two first groups G1 positioned immediately adjacent to each other and two second groups G2 positioned immediately adjacent to each other and following the two first groups G1. In this region of the two fabrics St1, St2, the two pile warp threads $P_2$, $P_2$ are used for providing the 3/6W-weave such that, at each pile point PP in each fabric St1, St2, two pile legs PS are present. In this region of the two fabrics St1, St2, the two pile warp threads $P_1$ and $P_3$ extend within the backing fabrics BF of the two fabrics St1, St2 in a straight manner.

Following the two second groups G2, there is a transition from the 3/6W-weave to the 1/3V-weave. The two pile warp threads $P_2$ stop forming pile elements and are interlaced around weft threads positioned between the two tension warp threads S1, S2 of the top fabric St1 and at the back side of the two tension warp threads S1, S2 of the bottom fabric St2 and then extend within the backing fabrics BF. In this region where the two pile warp threads $P_2$, $P_2$ are not used for forming pile points, the pile warp thread $P_1$ which, in the left part of FIGS. 3 and 4, is not used for forming piles, is used for forming piles by alternately interlacing this pile warp thread $P_1$ around the weft threads S which are positioned at the back sides SB of the backing fabrics BF of the fabrics St1, St2.

In the pile warp thread system shown in FIG. 3, pile warp thread $P_1$ is used throughout the entire region shown on the right side, while pile warp yarn $P_3$ is still not used for forming piles. In the pile warp thread system shown in FIG. 4, in the region in which the 1/3V-weave is generated, there is a transition between the two pile warp threads $P_1$ and $P_3$. As can be seen, pile warp yarn $P_1$ stops forming pile points by interlacing this pile warp thread $P_1$ around a weft thread S positioned between the two tension warp threads S1, S2 of the bottom fabric St2, while pile warp thread $P_3$ starts forming piles by interlacing this pile warp thread $P_3$ around a weft thread S located at the same position in the warp direction and positioned between the two tension warp threads S1, S2 of the top fabric St1.

As can be seen in FIGS. 3 and 4, in the region where the 1/3V-weave is generated, each pile point PP comprises a single pile leg PS in each of the fabrics St1, St2 after separating these two fabrics from each other. However, the pile density is the same as in the region where the 3/6W-weave is provided. It is to be noted that, due to the two weft threads S which are positioned on both sides of two pile legs PS constituted by the same portion of the pile warp threads $P_1$, $P_3$ after separating the two fabrics St1, St2 from each other, these two pile legs PS are urged against each other so that they appear to be present in a single pile point.

It is to be noted that, in such a combination of two different weaving structures, for example, one of the two pile warp threads $P_2$, $P_2$ can be used for forming pile elements in the 1/3V-weave area, while one or both of the pile warp threads $P_1$, $P_3$ can be used for forming pile elements in the 3/6W-weave area. The pile warp threads $P_1$, $P_2$, $P_2$, $P_3$ can be of different colour and/or of different structure or material. Of course, all these pile warp threads can have the same colour and/or can be constituted of the same material. Further, it is to be noted that, in accordance with the desired pattern of a carpet, the areas where each of these different weaving structures is used can be selected without any restriction. Of course, other weaving structures than the 1/3V-weave can be combined with a weaving structure comprising the various groups of weft threads and providing the shadow effect. Additionally, such other weaving structures can be used for providing binding elements which are present between two of the groups G1 and/or G2 of the 3/6W-weave. For example, such a binding element may comprise only one weft thread in association to each of the fabrics St1, St2 or may comprise a plurality of weft threads which may be located at any position relative to the tension warp threads S1, S2 of the respective fabrics St1, St2.

Figure 5:
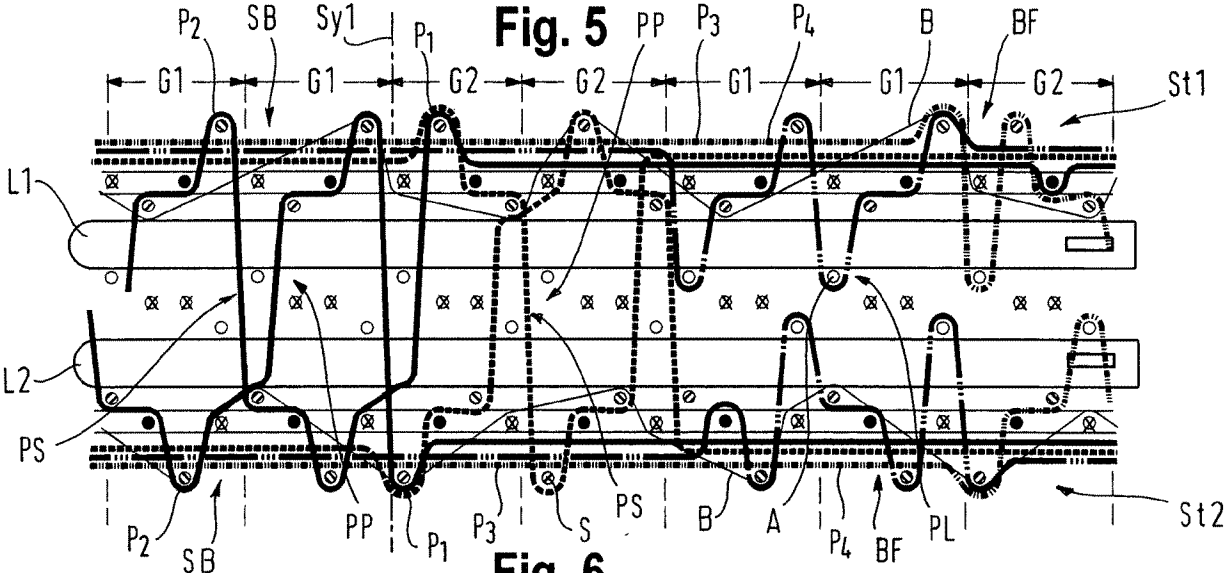
FIG. 5 shows a further alternative weaving structure of a warp thread system.
Figure 6:
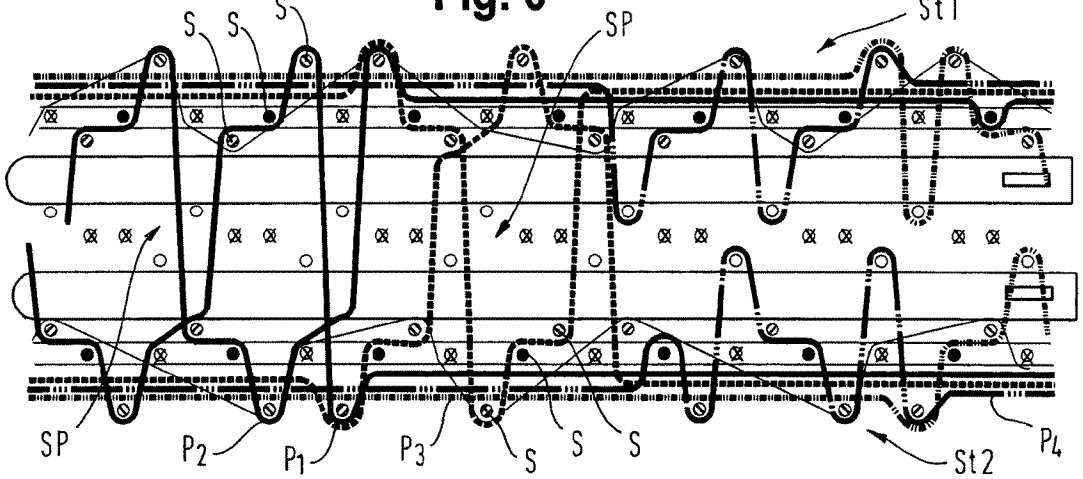
FIG. 6 shows the weaving structure of a warp thread system positioned adjacent to the warp thread system of FIG. 5.

Another alternative weaving structure is shown in FIGS. 5 and 6. Again, these two figures show two pile warp yarn systems associated to two immediately adjacent dents. These two pile warp yarn systems can be repeated alternately in the weft direction.

One major difference between the weaving structure shown in FIGS. 5 and 6 and the weaving structures shown in FIGS. 1 to 4 is that while, in the structures of FIGS. 1 to 4, two weft insertion means are used for inserting the weft threads S, i.e. one weft insertion means in association to each fabric St1, St2 to be woven, for obtaining the weaving structure shown in FIGS. 5 and 6, three weft insertion means, for example, three gripper mechanisms, are used. In FIGS. 5 and 6, those weft threads S which are used for forming the groups G1, G2 of weft threads are shown striped or black-coloured. Weft threads which are shown as crossed circles are weft threads which can be present, but normally will not be present. This can be obtained by only using the other weft insertion means in a particular weft insertion cycle or by not presenting a weft thread to one of the weft insertion means so that no thread is inserted. Weft threads which are shown as circles having no colour or pattern are auxiliary weft threads A, which are inserted between the two lancets L1, L2 and which, as will be explained later on, are used for forming pile loops as pile elements.

In the left part of FIGS. 5 and 6, there are shown two first groups G1 adjacent to each other and two second groups G2 adjacent to each other and adjacent to the two first groups G1. In this region of the fabrics St1, St2, there is a 3/8W-weave in which, in the regions where two such groups G1, G2 are adjacent to each other, a respective pile point PP comprising two pile legs PS is generated in each of the two fabrics St1, St2. Depending on whether these pile points PP are present between two first groups G1, or between two second groups G2, or between a first group G1 and a second group G2, the pile legs PS will be inclined either to the left side in the warp direction or to the right side in the warp direction or will not be inclined.

It can be seen in FIG. 5 that, in association to the two first groups G1 positioned on the left side, the two pile warp threads $P_2$, $P_2$ are used for forming pile points PP. In the region where the plane of symmetry Sy1, i.e. the transition between a first group G1 and a second group G2, is shown, there is a change from the pile warp threads $P_2$, $P_2$ to the pile warp threads $P_1$, $P_1$. It is to be noted that this transition appears by interlacing both pile warp threads $P_2$, $P_1$, i.e. the one starting forming pile points and the one ending forming pile points, around weft threads S which are positioned at the back sides SB of the backing fabrics BF of the two fabrics St1, St2. In the two second groups G2, G2, the pile warp threads $P_1$, $P_1$ are used for forming the pile points PP and pile legs PS, respectively.

The warp thread systems shown in FIGS. 5 and 6, additionally to the two pile warp threads $P_1$, $P_1$ and the two pile warp threads $P_2$, $P_2$, comprise two pile warp threads $P_3$, $P_3$ and two pile warp threads $P_4$, $P_4$. There is a total of eight pile warp threads and a group of four pile warp threads $P_1$, $P_2$, $P_3$, $P_4$ is associated to each of the two fabrics St1, St2 in such a manner that, in the region where it does not form pile elements, each of the pile warp threads of a respective group is bound into the associated fabric St1 and St2, respectively. The non-pile-forming pile warp threads are located in the region of the backing fabrics BF where the outer tension warp threads S1 are arranged, i.e. between a weft thread S positioned at the back side SB of the tension warp threads S1 and a weft thread S positioned between the two tension warp threads S1, S2 of a respective fabric St1, St2.

Following the region where the 3/8W-weave is generated, i.e. the region comprising the two first groups G1 and the two second groups G2 on the left side of FIGS. 5 and 6, there is a region in which two first groups G1 and a second group G2 are shown on the right side of FIGS. 5 and 6. In this region, a 3/4W-loop-weave is generated. This means that, in the region in which two groups G1, G1 or G1, G2 are adjacent to each other, there is no change of the pile warp threads from one of the fabrics to the other one, but the pile warp threads $P_3$, $P_4$ are interlaced with the auxiliary weft threads A positioned between the two lancets L1, L2. On both sides of such an auxiliary weft thread A, the pile warp threads $P_3$, $P_4$ are interlaced with a weft thread S of each of the two adjacent groups. After removing the two fabrics St1, St2 from the lancets L1, L2, these auxiliary weft threads A are drawn out of the pile loops PL so that, in the carpets constituted by the fabrics St1, St2, these auxiliary weft threads A will not be present. Finally, there will only be the weft threads S used for constituting the groups G1, G2 and, if desired, some of the crossed weft threads at particular positions.

Due to the fact that the pile loops PL are present in the regions where two groups G1, G2 or G1, G3 are adjacent to each other, the pile loops PL will be inclined depending on the kind of the two adjacent groups. In the region where two first groups G1 are adjacent to each other, the pile loops PL will be inclined to the left side in FIGS. 5 and 6, as the two weft threads between which such a pile loop PL is constituted are offset with respect to each other in a direction from the back side SB to the pile side SP. In the region where a first group G1 is adjacent to a second group G2, the pile loops PL will not be inclined, and in the region where two second groups G2 are adjacent to each other, the pile loops PL will be inclined to the right side.

FIGS. 7 and 8 show a further alternative embodiment of weaving structures of warp thread systems, for example repeatedly appearing in the weft direction in a carpet in an alternating manner. FIGS. 7 and 8 show weaving structures in which the groups G1, G2, G3 of weft threads S repeatedly appearing adjacent to each other in the warp direction are constituted by three weft threads S. It can be seen that the two weft threads S positioned at the two group end regions E1, E2 are thinner than the weft thread S positioned between these two weft threads in a centre region of each one of the groups G1, G2, G3. For example the two weft threads S positioned at the group end regions E1, E2 may have the same thickness, i.e. the same diameter when considering a cross-section thereof. Additionally, it can be seen that in each of the shown warp thread systems there is provided one single tension warp thread S1 in association to each one of the backing fabrics BF, i.e. the two carpets to be woven, as well as one single binding warp thread B. The thicker weft thread S of each of the groups G1, G2, G3 is positioned at the pile side SP of the associated tension warp thread S1, as is the case with the one weft thread S which is positioned at the respective first group end region E1. The other weft thread S positioned at the second group end region E2 is positioned at the back side SB of a respective backing fabric BF, i.e. a respective carpet to be woven.

When using such a thicker weft thread S in the centre region of a respective group G1, G2, G3, an additional influence on the inclination of the pile elements provided in the regions where the respective groups G1, G2, G3 are adjacent to each other can be obtained such that these pile elements PP have an increased inclination. This effect can further be enhanced when positioning these thicker weft threads S at the pile side SP of the respective tension warp thread S1.

Such thicker weft threads S positioned in the centre region of a respective group G1, G2, G3 may have a thickness that is in the range of 110% to 150%, preferably 150% to 200%, more preferably more than 200% of the thickness of the weft thread or weft threads S positioned at a respective group end region E1, E2. When considering such a thickness, this, for example, can refer to the diameter of the respective threads which, for example, may have a substantially circular cross-section at least in regions where no lateral load is applied to such threads.

It is to be noted that of course the two weft threads S positioned at the group end regions E1, E2 can, but must not have the same thickness. One of these two weft threads may be thicker than the other one and may even have the same thickness as the weft thread positioned in the centre region of a respective group G1, G2, G3. It is further to be noted that such a structure can even be used if at least one of the groups comprises more than three weft threads. In this situation, at least one of the weft threads positioned between the two weft threads positioned at the group end regions E1, E2, preferably all of these weft threads may be thicker than at least one of the weft threads positioned at the group end regions. Further, it is to be noted that such a weaving structure using thicker weft threads may be used in each different type of group G1, G2, G3 or, for example, only may be used in one or some of the different types of groups. Preferably each group of a particular type of group having at least one such a thicker weft thread in the centre region thereof is provided in this way, while it is not excluded that some groups of a particular type of group can be provided for example with weft threads having the same thickness or having a thicker weft thread at at least one group end region.

FIGS. 7*a* and 7*b* show a lower part of FIG. 7 after having cut the pile warp threads extending between the two backing fabrics in the middle between the backing fabrics. FIGS. 7*a* and 7*b* show two different sections of a carpet in the warp direction, each one showing the pile warp threads generated by and the tension warp threads of a single warp thread system. For example, FIGS. 7*a* and 7*b* show the pile warp threads and the tension warp threads associated with two immediately adjacent warp thread systems.

FIGS. 9 and 10 show a further alternative also using thicker weft threads in the centre regions of the respective groups G1, G2, G3. In the warp thread systems shown in FIGS. 9 and 10 differently coloured and/or differently structured pile warp threads P1, P2 may be used for providing a colour pattern and/or a structural pattern in the carpet to be woven. A change between the two pile warp threads used for constituting pile elements PP for example may appear between two adjacent groups G1 and G2 in such a manner that the two pile elements PP constituted in the region where the two groups G1, G2 are adjacent to each other are provided by warp threads $P_2$ having the same colour and/or structure.

From the above description, it becomes clear that, when producing a carpet having a shadow effect weaving structure, there is a high variability in combining this shadow effect weaving structure with other weaving structures. In addition, the shadow effect weaving structure may not only be used for forming pile legs in a carpet, but can also be used for providing a carpet or areas in a carpet with pile loops.

The structures shown can be varied in different aspects. For example, it is possible to use more than one binding warp thread in the warp thread systems and in association to each fabric to be woven, so that even with one and the same pile warp thread system it will be possible to fix each one of the weft threads to the backing fabric. For example, two binding warp threads could be used in each or at least a part of the pile warp thread systems and in association to each fabric to be woven.

The invention claimed is:

1. Carpet fabric comprising a backing fabric having weft threads and tension warp threads, further comprising pile warp threads interlaced with the weft threads of the backing fabric and forming pile elements, the weft threads being provided in groups of weft threads repeatedly appearing in a warp direction and comprising weft threads positioned adjacent to each other, each group of weft threads being provided for interlacing with the pile warp threads and thereby forming the pile elements, one of the weft threads of each group of weft threads being positioned at and providing a first group end region and another one of the weft threads of each group of weft threads being positioned at and providing a second group end region, each group of weft threads providing a relative positioning of the weft threads thereof relative to at least one tension warp thread, a weft thread of a group being either positioned on a pile side relative to a tension warp thread or on a back side relative to this tension warp thread in a respective relative positioning, a first group of weft threads having a first relative positioning of the weft threads thereof and a second group having a second relative positioning of the weft threads thereof different from the first relative positioning, wherein the first relative positioning and the second relative positioning provide a substantially mirror-symmetrical arrangement with respect to each other relative to a plane of symmetry extending in the weft direction and being perpendicular to the warp direction, wherein in each relative positioning of first relative positioning and second relative positioning a weft thread positioned at a first group end region in the warp direction and a weft thread positioned at a second group end region in the warp direction have a different relative positioning with respect to at least one tension warp thread, wherein at least one first group is provided immediately adjacent to a second group in the warp direction, wherein a plurality of warp thread systems extending in the warp direction comprising the tension warp threads and the pile warp threads are provided side by side, a row of pile elements extending in the warp direction being provided by each warp thread system, wherein a plurality of warp thread systems comprises one single tension warp thread, wherein the tension warp threads of different warp thread systems comprising one single tension warp thread are offset with respect to each other in a direction from the pile side to the back side.

2. Carpet fabric according to claim 1, wherein at least one first group is arranged immediately adjacent to a first group in the warp direction, and/or at least one second group is provided immediately adjacent to a second group in the warp direction.

3. Carpet fabric according to claim 1, wherein a third group has a third relative positioning of the weft threads thereof which is different from the first relative positioning and the second relative positioning, at least one third group being positioned between two first groups and/or between two second groups and/or between a first group and a second group.

4. Carpet fabric according to claim 3, wherein the weft threads of the third group are arranged substantially mirror-symmetrical with respect to each other relative to a symmetry plane extending in the weft direction and being positioned in a central region of the third group in the warp direction, and/or a weft thread positioned at a first group end region of a third group in the warp direction and a weft thread positioned at a second group end region of the same third group in the warp direction have the same relative positioning with respect to at least one tension warp thread.

5. Carpet fabric according to claim 1, wherein in the first group of weft threads and/or the second group of weft threads and/or a third group of weft threads a weft thread positioned at a first group end region in the warp direction and/or a weft thread positioned at a second group end region in the warp direction is thinner than at least one weft thread positioned therebetween in the warp direction.

6. Carpet fabric according to claim 1, wherein in at least one row of the pile elements there is at least one change in the type of the pile warp threads used for providing the pile elements.

7. Carpet fabric according to claim 6, wherein in the first group of weft threads and/or the second group of weft threads and/or a third group of weft threads a weft thread positioned at a first group end region in the warp direction and/or a weft thread positioned at a second group end region in the warp direction is thinner than at least one weft thread positioned therebetween in the warp direction, wherein the thickness of such a thicker weft thread positioned between two weft threads positioned at the group end regions is in the range of 110% to 150% of the thickness of at least one weft thread positioned at a group end region, and wherein at least one of the warp thread systems comprises one of the tension warp threads, and wherein the at least one weft thread positioned between the weft threads positioned at the group end regions is positioned at a pile side of the tension warp thread.

8. Carpet fabric according to claim 1, wherein at least one warp thread system comprises two of the tension warp threads offset with respect to each other in a direction from the pile side to the back side.

9. Carpet fabric according to claim 8,
wherein two tension warp threads are separated in the direction from the pile side to the back side by at least one weft thread.

10. Carpet fabric according to claim 9,
wherein each first group of weft threads and/or each second group of weft threads and/or each third group of weft threads comprises at least one weft thread positioned at the pile side of the two tension warp threads and at least one weft thread positioned at the back side of the two tension warp threads.

11. Carpet fabric according to claim 9,
wherein each first group of weft threads and/or each second group of weft threads comprises at least one weft thread positioned between the two tension warp threads.

12. Carpet fabric according to claim 1,
wherein at least one warp thread system comprises at least one binding warp thread.

13. Carpet fabric according to claim 1,
wherein
the first group and the second group comprise three weft threads, respectively,
and/or
a first group and a second group comprise the same number of weft threads.

14. Carpet fabric according to claim 1,
wherein
the pile element are provided in at least one region where two groups are adjacent to each other,
and/or
the pile elements are provided substantially only in a region where two groups are adjacent to each other.

15. Carpet fabric according to claim 1,
wherein
in a region where a first group and a further first group are adjacent to each other at least one pile leg or a pile loop providing a pile element is inclined in the warp direction in a first orientation, and in a region where a second group and a further second group are adjacent to each other at least one pile leg or a pile loop providing a pile element is inclined in the warp direction in a second orientation opposite to the first orientation,
and/or
in a region where a first group is adjacent to a second group or in a region where a third group is adjacent to a third group at least one pile leg or a pile loop providing a pile element is substantially not inclined in the warp direction,
and/or
a third group has a third relative positioning of the weft threads thereof which is different from the first relative positioning and the second relative positioning, at least one third group being positioned between two first groups and/or between two second groups and/or between a first group and a second group, and wherein in a region where a third group is adjacent to a first group or a second group at least one pile leg or pile loop providing a pile element is inclined in the warp direction or is substantially not inclined.

16. Carpet fabric according to claim 1,
wherein, between at least two adjacent groups of weft threads, a binding element different from the first group of weft threads, the second group of weft threads is provided, said binding element comprising at least one weft thread offset with respect to each other in the warp direction and/or the direction from the pile side to the back side.

17. Carpet fabric according to claim 1,
wherein at least one weft thread comprises fibrillated yarn and/or is made of polypropylene material.

18. Carpet fabric according to claim 1,
wherein at the back side a ground contact material is arranged engaging into the backing fabric.

19. Carpet fabric according to claim 5,
wherein the thickness of such a thicker weft thread positioned between two weft threads positioned at the group end regions is in the range of 110% to 150% of the thickness of at least one weft thread positioned at a group end region.

20. Carpet fabric according to claim 9,
wherein a third group has a third relative positioning of the weft threads thereof which is different from the first relative positioning and the second relative positioning, at least one third group being positioned between two first groups and/or between two second groups and/or between a first group and a second group, and wherein each third group of weft threads comprises at least one weft thread positioned at the pile side of the two tension warp threads and at least one weft thread positioned at the back side of the two tension warp threads.

21. Carpet fabric according to claim 1,
wherein a third group has a third relative positioning of the weft threads thereof which is different from the first relative positioning and the second relative positioning, at least one third group being positioned between two first groups and/or between two second groups and/or between a first group and a second group, and wherein each third group of weft threads comprises at least one weft thread positioned at the pile side of the two tension warp threads and at least one weft thread positioned at the back side of the two tension warp threads, and
wherein between at least two adjacent groups of weft threads, a binding element different from the first group of weft threads, the second group of weft threads, and the third group of weft threads is provided, said binding element comprising a plurality of weft threads offset with respect to each other in the warp direction and/or the direction from the pile side to the back side.

22. Carpet fabric according to claim 1, wherein the weft threads in each group are spaced at regular intervals within each group.

* * * * *